US005291836A

United States Patent [19]

Beamer

[11] Patent Number: 5,291,836

[45] Date of Patent: Mar. 8, 1994

[54] SPACER ASSEMBLY

[75] Inventor: John W. Beamer, Grand Haven, Mich.

[73] Assignee: Lorin Industries, Inc., Muskegon, Mich.

[21] Appl. No.: 902,874

[22] Filed: Jun. 23, 1992

Related U.S. Application Data

[63] Continuation-in-part of Ser. No. 757,645, Sep. 11, 1991, Pat. No. 5,211,117.

[51] Int. Cl.[5] ..... B65D 19/00

[52] U.S. Cl. ..... 108/51.1; 108/53.1

[58] Field of Search ..... 108/51.1, 53.1, 56.3, 108/53.3, 53.5

[56] References Cited

U.S. PATENT DOCUMENTS

| | | | |
|---|---|---|---|
| 2,455,197 | 11/1948 | Sullivan | 108/51.1 X |
| 2,640,669 | 6/1953 | Ashford | 108/53.1 X |
| 2,692,107 | 10/1954 | De Ridder et al. | 108/51.1 |
| 3,616,766 | 11/1971 | Weiss | 108/51.1 |
| 3,699,900 | 10/1972 | Carlson | 108/53.1 |
| 3,926,321 | 12/1975 | Trebilcock | 108/53.1 X |
| 4,485,744 | 12/1984 | Umemura et al. | 108/51.1 |
| 5,101,757 | 4/1992 | Gomez | 108/51.1 |

*Primary Examiner*—Jose V. Chen

*Attorney, Agent, or Firm*—Price, Heneveld, Cooper, Dewitt & Litton

[57] ABSTRACT

A spacer to facilitate cooling, stacking, and handling of meat includes first and second channels, preferably of identical cross-sectional shape, placed transverse to each other so as to define multiple interconnected passageways for conducting conditioned air therethrough when placed in a stack of alternating layers of boxed meat and spacers. The channels include lateral flanges which are bonded to each other at a plurality of intersections by adhesive, and may also be joined by pressing a section of material from one lateral flange through the thickness of a section of the other lateral flange followed by clinching the sections together. The clinched sections hold the intersections together until the adhesive cures, and also contribute to the ultimate joint strength. The first channels further include outwardly protruding embossments and the second channels include apertures for receiving the embossments, the apertures and embossments acting as locaters to locate adjacent spacers when stacked on each other for storage while awaiting use.

23 Claims, 3 Drawing Sheets

SPACER ASSEMBLY

This is a continuation-in-part of U.S. patent application Ser. No. 07/757,645, filed Sep. 11, 1991, now U.S. Pat. No. 5,211,117 and entitled, PALLET ASSEMBLY the disclosure of which is incorporated herein by reference.

BACKGROUND OF THE INVENTION

The present invention relates to a spacer for the food industry useful to facilitate cooling, storage and transportation of packaged meat and the like.

Heretofore, the meat packaging industry has primarily used wood and plastic separators to separate cartons or boxes of processed meats ready to be cooled before shipping or storage. However, the wood and plastic separators are deficient in several ways. Wood and plastic are poor conductors of heat and thus slow the cooling process. Further, the present spacers of wood and plastic do not provide for maximum cross-flow of air. Still further, they are not as durable or repairable as is desired. At the same time, disposal is becoming increasingly expensive due to environmental concerns. For example, wood spacers commonly must be burned as opposed to landfilled. Wood also has the particular problems of splintering and is highly absorbent of liquids such as blood. Further, wood cannot be cleaned and sanitized by conventional methods.

One instance is known where an aluminum separator or spacer was used. The 40 inch by 48 inch spacer consisted of 15 hat-shaped channels, seven of which were oriented transversely to the others and interconnected thereto by rivets, the spacer having a total weight of about 24.5 pounds. However, this spacer presents opportunities for improvement. First, it is desirable that a spacer for use in this application be light in weight so that it is easily handled. Further, there is a risk that rivets will break loose over time and fall into the boxed meat. Hence, it is desirable to use a fastenerless system of attachment which avoids possibilities of contamination, and yet also provides the degree of strength desired so that the spacer does not break apart over time while in service. Still further, it is desirable to utilize materials and material bonding techniques offering improved strength over traditional lower-strength extrudable aluminums connected by rivets so that weight is minimized, and overall performance and service life are increased. It is also desirable to reduce striations and the like to reduce the tendency to entrap blood, meat particles, and the like on the spacer. Additionally, it is desirable to provide a spacer that can be stored in uniformly square stacks without tending to skew, to facilitate material handling.

Thus a device is needed which is light in weight, durable, repairable, cleanable, has high strength, and which facilitates cooling of packages of meat and otherwise improves upon the problems noted.

SUMMARY OF THE INVENTION

The present invention is a spacer to facilitate the cooling, stacking, transportation and handling of packaged meat and the like. The spacer includes a plurality of first and second channels interconnected to form multiple passageways so that conditioned air can be freely circulated between and through the channels when the spacers are stacked in a multi-layered arrangement with packages of meat. The channels each include lateral flanges which are positioned to engage at intersections where they are joined by adhesive, and further include webs spaced from the flanges having support surfaces for supporting packages of meat thereon to prevent undesired sagging of the packages of meat when stacked.

In one form, the joining means includes a section of material from one of the lateral flanges that is pressed through the thickness of an aligned section of another of said flanges, the sections being clinched together so as to form a secure interconnection of the two lateral flanges. Thus, the clinched sections hold the intersections together while the adhesive cures, and also contribute to the ultimate strength of the joint.

In another form, the spacer includes locating means for locating a particular spacer when stacked on another identical spacer, the locating means allowing the spacers to be stacked for storage in a uniformly square stack and with a reduced tendency to skew as spacers are added or removed from the stack.

As will be understood by persons skilled in the art, numerous advantages over the prior art known spacers are provided by this invention. The adhesive offers improved joint strength so that the spacer is longer lasting even with heavy use while in service. Also, the spacer facilitates material handling by providing locaters to hold the spacers in a uniformly square stack. Thus, when stacked, the spacers do not tend to skew even though the aluminum to aluminum contact has a fairly low coefficient of friction.

Also, the spacer includes improved air flow and heat transfer, thus reducing cooling time and improving operating efficiency of the meat cooling process. The air flow is improved by providing passageways in two normally oriented directions with open cross-flow therebetween. The construction further assists in heat transfer due to the thermal conductivity of the channels, particularly where aluminum and/or thin gauges of metal are used. Further, the spacers offer improved durability and repairability, and also are cleanable and sanitizable by conventional methods. The spacers of the present invention resist contamination and will not easily stain. Additionally, the aluminum material will not splinter, tear or break, and offers increased load capacity while maintaining the necessary light weight of the spacer. In the preferred embodiment, the construction is fastenerless and thus does not have fasteners that can break loose and contaminate or become lost in the meat. Further, worker safety is increased by radiusing the corners and hemming the edges of the spacer to reduce sharp protrusions. Also, the spacer is constructed of channels with a common roll-formed cross-sectional shape, thus allowing the assembly to be entirely made from long and short lengths of the same sectional shape thereby simplifying the manufacturing process. Roll-forming also allows the channels to be made of materials having significantly greater strength than extruded channels. Further, the spacing between channels can be tailored to the particular need of the intended use, i.e. to adequately support the boxes or packages of meat while minimizing the number of channels used.

These and other objects, advantages, purposes, and features of the invention will become more apparent to a person skilled in the art from a study of the following description taken in conjunction with the drawings.

BRIEF DESCRIPTION OF THE PREFERRED EMBODIMENT

Figure 1:
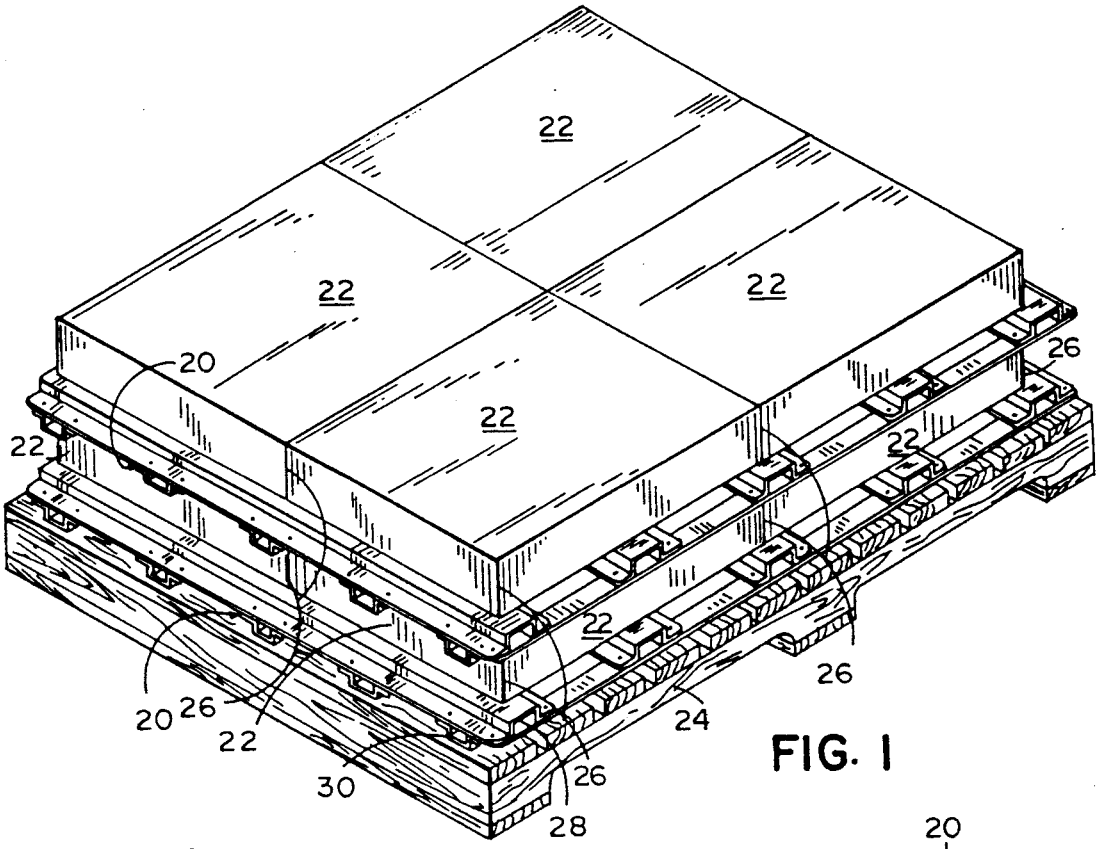
FIG. 1 is a perspective view of spacers embodying the present spacers being shown as alternatingly between layers of boxes of meat.
Figure 2:
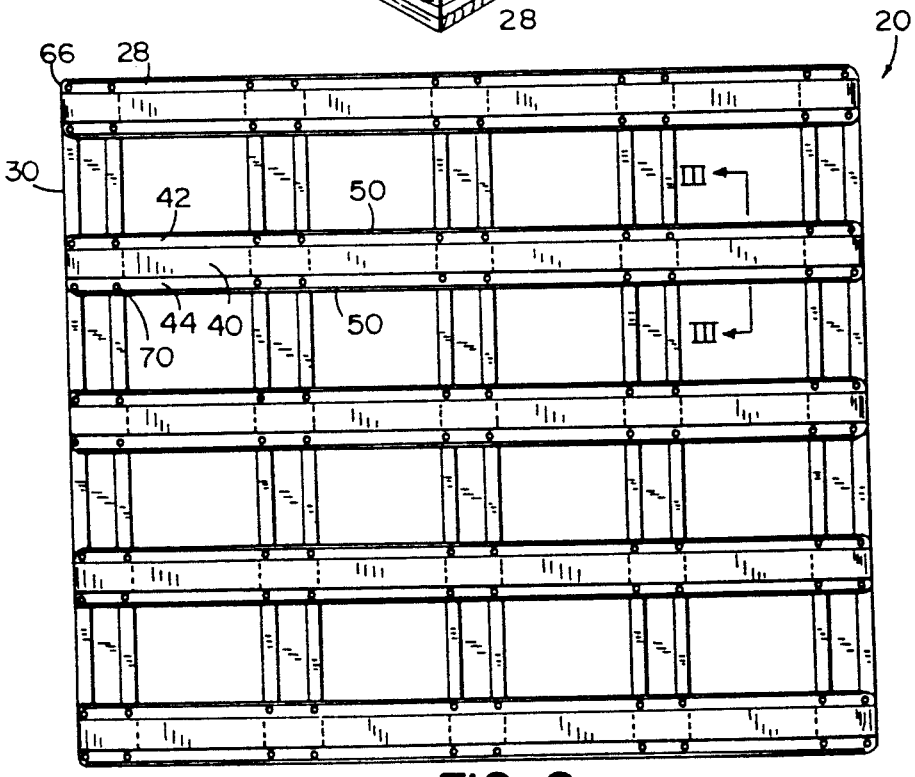
FIG. 2 is a plan view of the spacer.

Referring now to the drawings in greater detail, FIGS. 1 and 2 illustrate a spacer 20 embodying the present invention. Spacer 20 is especially adapted for use in the meat industry to provide a high strength spacer to vertically separate boxes or packages 22 of meat placed in a vertical multi-layered arrangement such as is shown in FIG. 1 on a pallet 24. By spacing the boxes 22 apart, spacers 20 facilitate cross-flow of conditioned air, thus facilitating the cooling of the meat. In the embodiment shown, four boxes 22 are shown on each layer, although more or less boxes can be used. Typically, the arrangement is stacked about 8 layers high.

Figure 3:
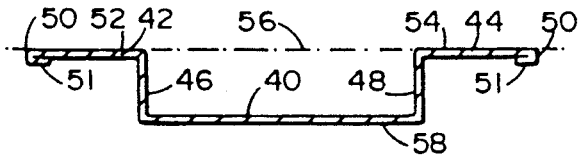
FIG. 3 is a sectional view taken along the plane III—III of FIG.
Figure 4:
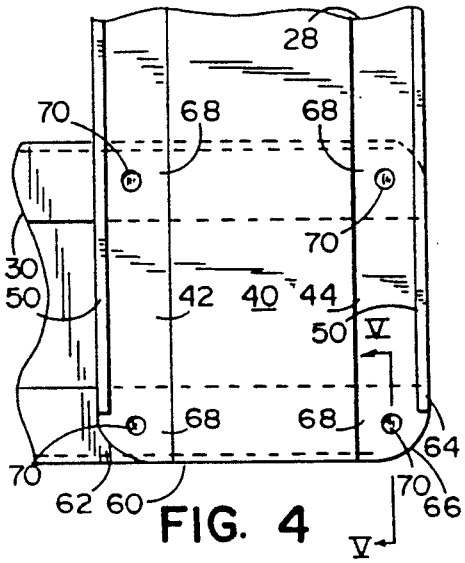
FIG. 4 is an enlarged plan view of a corner of the spacer of FIG. 2

Spacer 20 (FIGS. 2–4) is constructed of first and second channels or elongated panels 28 and 30 which extend in first and second directions normal to each other to make a spacer 20 of about 40" by 48" by 1" thick. Notably, thicker spacers of about 2" thickness could be made for increased air flow if desired, and these dimensions are not intended to be construed as unnecessarily limiting. Channels 28 and 30 have identical cross-sectional shapes (FIG. 3), thus permitting them to be made from a common roll-formed or extruded shape to facilitate manufacture. Each channel 28 and 30 has a hat-shaped or "U" shaped section with a web 40 and laterally extending flanges 42 and 44 connected by connecting walls 46 and 48. Flanges 42 and 44 have an outer hemmed edge 50 with a marginal outer edge 51 which is folded back on itself to increase worker safety by reducing worker exposure to sharp edges. Hemmed edge 50 is tightly pressed against the associated flange to minimize entrapment of blood, meat particles, and the like. Hemmed edge 50 also strengthens the edge of flanges 42 and 44, and provides a grip for pulling spacers 20 apart from boxes 22 after freezing. Hemmed edge 50 is folded toward web 40 so that flanges 42 and 44 provide a flat surface 52 and 54 on central plane 56. Web 40 also provides an enlarged flat support surface 58 defining a plane opposite and spaced from central plane 56.

Hemmed edges 50 (FIG. 4) extend substantially the length of channels 28 and 30, but end just short of end 60, forming a corner 62 with end 60. Corner 62 is radiused to eliminate sharp protrusions thereon and reduce curling of the corners. The outermost flanges 42 and 44 on outermost channels 28 and 30 form a perimeter 64 along central plane 56, the corners 62 forming the four corners 66 of the overall spacer perimeter 64.

During manufacture of spacer 20, channels 28 (FIGS. 4–6) are inverted and placed at right angles onto channels 30 to form a matrix of channels. In this position, four planar areas of contact or engagement 68 of flanges 42 and 44 (FIG. 4) are formed at each intersection of channels 28 and 30. Areas 68 are conducively flat for joining channels 28 and 30 so as to form a rigid spacer unit. Additionally, channels 28 and 30 can be spaced as desired and still provide areas 68 for joining. For example, it may be desirable to space channels 28 and 30 more closely so as to support smaller packages of meat. Thus, manufacture of spacers 20 is readily adaptable to varying spacer needs.

Figure 5:
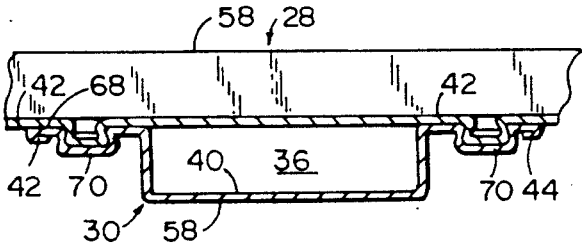
FIG. 5 is a sectional view of the spacer taken along the plane V—V FIG. 4.
Figure 6:
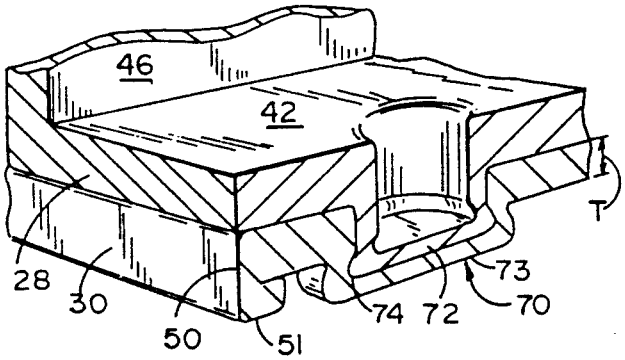
FIG. 6 is an enlarged perspective view of a joint.

In the preferred embodiment, flanges 42 and 44 are joined by a fastenerless system of attachment or joint 70 (FIGS. 5 and 6). This reduces the chance of fasteners or other pieces coming loose over time, and falling into, and contaminating the packages of meat. It is contemplated that welding, riveting, or bent tabs could be used, but in the preferred embodiment a Tog-L-Loc® system of joining is used such as that sold by BTM Corporation of Marysville, Mich. Such a system of attachment is described in more detail in U.S. Pat. No. 4,459,735 to Sawdon entitled Joining Sheet Metal, issued Jul. 17, 1984, the entire contents of which are hereinafter incorporated by reference, and also in subsequently issued patents related thereto. Product literature on Tog-L-Loc® joining systems suggests that it will acceptably work on sheet metal thicknesses of at least 0.060 inches. As best shown in FIG. 6, a slug or section of material 72 from one of channels 28 and 30 is deformably drawn or pressed through the thickness "T" of an aligned section 73 of a flange of the other channel, forming a rivet-like protrusion therein. Sections 72 and 73 are then clinched to form an enlarged head 74 thereon, head 74 being larger than the diameter of the aperture through which it came. Thus a secure attachment is formed tightly holding flanges 42 and 44 together in close proximity so as to prevent liquid or particles from becoming entrapped therein. Presently, it is contemplated that all joints 70 will be made during a single hit or press stroke by suitable forming dies including spaced, multiple punches and anvil pins of the type described in U.S. Pat. No. 4,459,735 mentioned above (not shown). Notably, the dies will be adjustable so that channels 28 and 30 can be spaced as desired.

Figure 7:
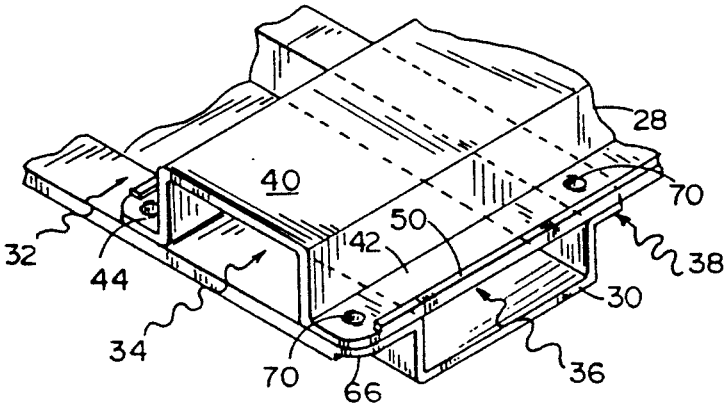
FIG. 7 is a perspective view of FIG. 4 showing air flow.
Figure 8:
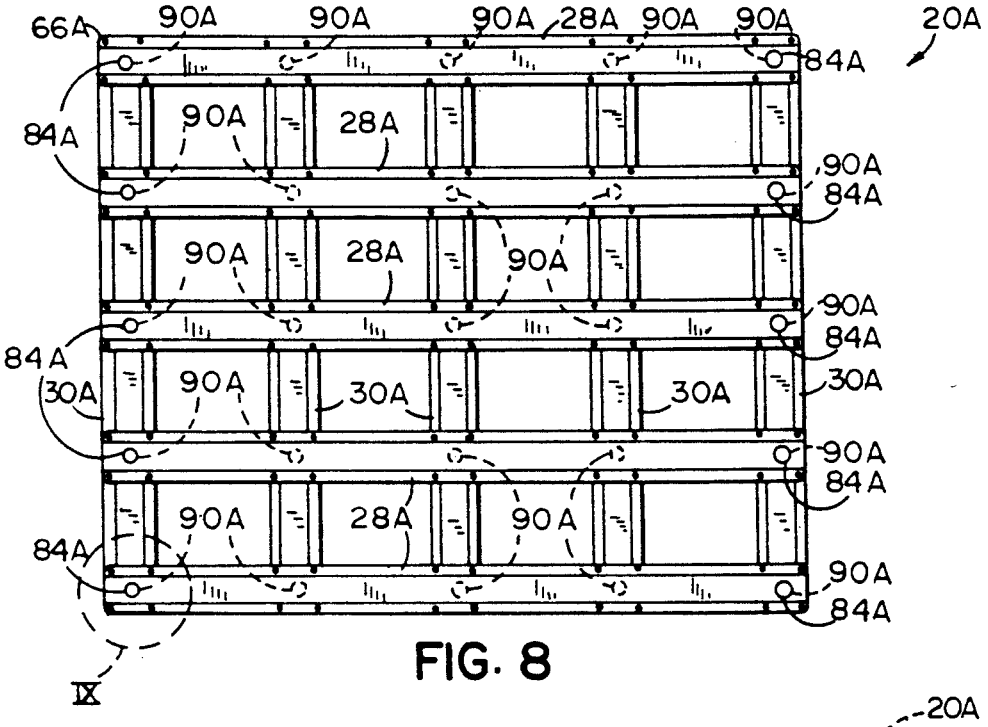
FIG. 8 is a plan view of a modified spacer embodying the present invention.
Figure 9:
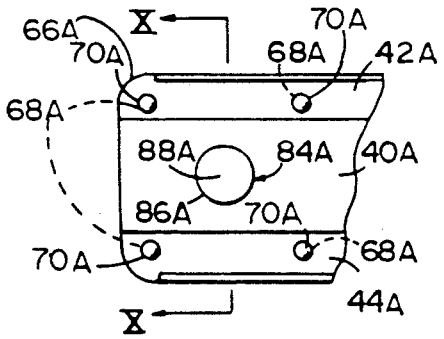
FIG. 9 is an enlarged fragmentary view of a corner of the spacer FIG. 8.

When fully assembled, spacer 20 provides multiple passageways 32, 34, 36 and 38 (FIG. 7) for conducting conditioned air therethrough. Additionally, air can flow between the passageways, thus enhancing air flow. Also, heat can be conducted through the channel materials thus further promoting efficient cooling. It is contemplated that use of spacers 20 will improve the cooling time for boxed meat by about 12 to 20% over the wood or plastic spacers presently used. Spacers 20 offer about twice the air flow of known wood pallet-like spacers with solid cross-members or plastic "egg-carton" like spacers.

Preferably, channels 28 and 30 are made from a 0.040 inch thick sheet of #3005 aluminum alloy which is hardened to an H34 temper, although alternative materials could be used. It is noted that #3000 aluminum alloys and in particular #3003 aluminum alloy can also be used since these materials have good workability and work acceptably with the Tog-L-Loc® fastening system. Aluminum alloy offers a high strength to weight ratio along with formability, corrosion resistance, cleanability, and recycleability. Additionally, aluminum has a good thermal conductivity and also can be readily repaired as needed. Testing has shown that a spacer of the above noted construction made from #3005 alloy can satisfactorily hold up to 12,000 pounds. Notably, most meat processors only require about 1900 pounds of load (i.e. about 240 pounds of boxed meat per layer and stacked 8 layers high). Also, aluminum allows the spacers to be cleaned and sanitized by conventional methods. Further, aluminum does not stain.

The beam-like construction of spacer 20 permits the spacing between channels 28 and also between channels 30 to be adjusted so as to optimally place webs 40 for supporting edges 26 of boxes 22. Further, damaged spacers 20 can be repaired by reworking or replacing individual channels. Still further, the spacing between channels permits fork truck forks to be inserted therebetween, facilitating movement of the spacer when needed.

Having described the spacer and various items related thereto, the use and advantages of the present invention will become apparent to one skilled in the art. It is contemplated that the invention could be used in a variety of ways, though only one way is hereinafter described. Channels 28 and 30 initially are cut from stock to form a blank having a predetermined length and radiused corners. The blank is then roll-formed or extruded into a beam into a U-like sectional shape with hemmed flanges 42 and 44 and web 40 to form channels 28 and 30. Channels 28 are inverted and placed perpendicularly on channels 30 so that flanges 42 and 44 contact along a central plane 56 to form areas of contact 68. Channels 28 and 30 are spaced as desired, and are joined by fastenerless attachments 70 at each area 68 as described in U.S. Pat. No. 4,459,735 mentioned above.

Once assembled, spacer 20 can be placed on a pallet 24 in alternating layers with boxes of meat 22. Various sized boxes 22 can be used, but it is contemplated that the top and bottom of edges 26 of boxes 22 will be positioned on (or under) web 40 as much as possible so that the boxes 22 will be optimally supported in a square and uniform manner. Thus, when alternating layers of boxes 22 and spacers 20 are stacked 8 layers high, the arrangement will remain upright and erect, and not sag unacceptably. This facilitates placement of the stack into a freezer, into refrigerated trucks or trailers for transportation, or the like.

MODIFICATION

A modified spacer 20A embodying the present invention is shown in FIGS. 8–12. Components and features of spacer 20A that are similar to the components and features of spacer 20 are generally designated with the same number but with the letter "A" added to the number. Thus, the above discussion concerning spacer 20 applies to the modified spacer 20A, except with the modifications noted below.

Figure 10:
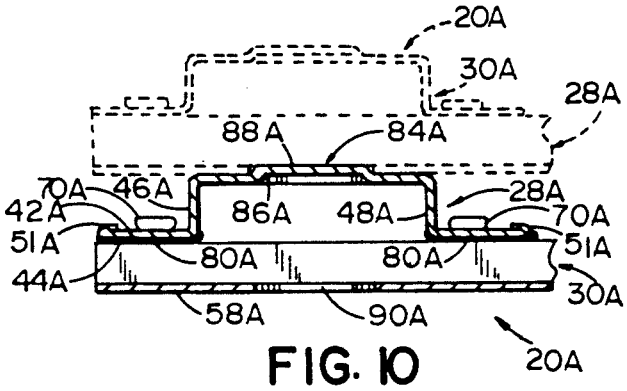
FIG. 10 is an enlarged cross-sectional view taken along the line FIG. 9.
Figure 11:
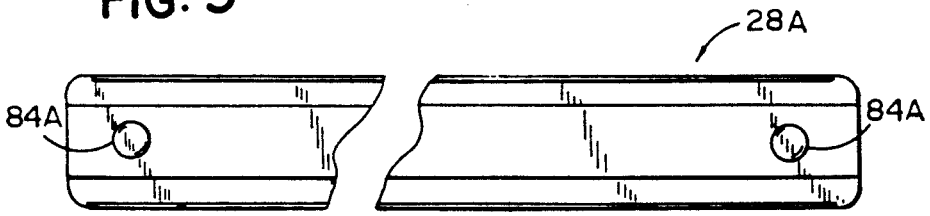
FIG. 11 is a fragmentary plan view of a first channel as shown in FIG. 8.
Figure 12:
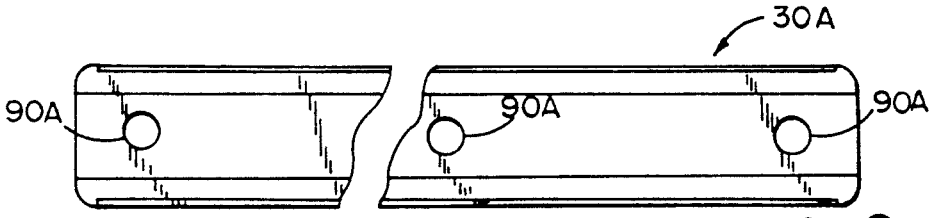
FIG. 12 is a fragmentary plan view of a second channel as shown in FIG. 9.

Spacer 20A includes an improved joinder of flanges 42A and 44A by the addition of adhesive 80A therebetween (FIG. 10). It is contemplated that several different adhesives can be used; however, in the preferred embodiment a two-part room temperature curing epoxy adhesive is used. In particular, an epoxy adhesive manufactured by 3M Company of St. Paul, Minn. under the name Scotch-Weld TM EC-2216B/A Grey Adhesive has been found satisfactory, the adhesive when applied as directed having a hardening time to handling strength of 8–12 hours, a minimum overlap shear strength of 2500 PSI at 75° F. (ASTM D-1002-64), and a minimum T-Peel strength of 25 PIW at 75° F. (ASTM D-1876-61T).

In the preferred embodiment, flanges 42A and 44A are also joined by a fastenerless system of attachment or joint 70A such as is previously shown in FIGS. 5 and 6. The fastenerless system of attachment reduces the chances of a fastener or other piece coming loose over time, and falling into and contaminating the packages of meat. It is contemplated that welding, riveting or bent tabs could be used, but in the preferred embodiment a Tog-L-Loc® system of joining is used, as previously described. Notably, the Tog-L-Loc® system of joining holds the flanges 42A and 44A together while the adhesive 80A cures, and also contributes to the ultimate strength of the joint. Specifically, testing has shown the use of adhesive 80A increases joint strength from a pull strength of about 125 PSI per area 68 in spacer 20 to a pull strength of about 2000 PSI per area 68A (or about 8000 PSI per set of four areas 68A) in spacer 20A. Notably, adhesive 80A can be placed at all of areas 68, of which there are one hundred in number on spacer 20A, or adhesive 80A need only be placed at strategic locations such as around the perimeter of spacer 20A.

Spacer 20A further includes a locating assembly so that spacers 20A can be stacked one on another for compact storage to form a uniform stacked arrangement. Notably, aluminum on aluminum has a relatively low coefficient of friction which causes spacers 20A to easily slide on each other when multiple spacers 20A are stacked on one another for storage while awaiting use. This problem is aggravated by the light weight of the spacers 20A. Thus, individual spacers in a given stack can skew unless care is taken to keep the spacers in the stacked arrangement square and in alignment.

As shown, all five channels 28A (FIGS. 8 and 11) include a circularly-shaped embossment 84A located at each end of the channel, embossment 84A being located centrally on each panel 28A and spaced a distance from the extreme end of channel 28A so that embossment 84A is located centrally over the transverse channel 30A located therebelow. Embossment 84A protrudes outwardly a distance somewhat greater than the thickness of the material in channel 28A (FIG. 10), but only as far as needed to satisfactorily act as a locating pin. Embossment 84A includes a substantially perpendicular shoulder 86A and a disk-like top 88A.

Channels 30A (FIGS. 8, 10 and 12) each include multiple spaced apertures 90A, apertures 90A having a diameter adapted to receive embossment 84A, and being positioned along the length of channels 30A so that, regardless of which particular channel 30A is located at the outer ends of channel 28A, the apertures 90A and outer channel 30A are positioned to receive each of embossments 84A. As best shown in FIG. 10, multiple spacers 20A can thus be reliably stacked in storage while not in use, with embossments 84A engaging apertures 90A and holding adjacent spacers 20A in a uniform and square arrangement.

It is contemplated that embossments 84A and apertures 90A can be formed by a number of different processes and at different times during the forming of channels 28A and 30A. In the contemplated method, a strip of stock is uncoiled from a roll of aluminum sheet and slit to the desired width. The strip is then fed into a die where the slit strip is cut to length with the desired end shape by a stamping die. The stamping die for making blanks for channel 28A also forms embossments 84A at each end, while the stamping die for making blanks for channel 30A also forms apertures 90A. Once a blank is formed, the blank is fed into a roll-forming process for forming the hat-shaped cross section which is a characteristic of channels 28A and 30A.

Channels 30A are then arranged in parallel and drops of adhesive 80A are placed on contact areas 68A. Channels 28A are then positioned on channels 30A transversely, and joints 70A are formed simultaneously or by a successive operation of a Tog-L-Loc ® joint forming machine. In the preferred embodiment, adhesive 80A is adapted to cure at room temperature as joints 70A hold channels 28A and 30A firmly together.

While several forms of the invention have been shown and described, other forms will now be apparent to those skilled in the art. Therefore, it will be understood that the embodiment shown in the drawings and described above are merely for illustrative purposes, and are not intended to limit the scope of the invention which is defined by the claims which follow and as interpreted by the Doctrine of Equivalents.

The embodiments of the invention in which an exclusive property or privilege is claimed are defined as follows:

1. A spacer for supporting packages, comprising:

a plurality of first elongate members extending in a first direction;

a plurality of second elongate members extending in a direction substantially normal to said first direction, said first and second elongate members engaging one another at a plurality of intersections, said first and second elongate members defining a pair of spaced parallel support surfaces for supporting packages placed thereagainst and forming multiple interconnected passageways therebetween for communicating conditioned air therethrough, said first and second elongate members having a structural strength permitting layers of said packages to be alternatingly stacked with said spacers to form a multi-layered arrangement to facilitate cooling, stacking, transporting and handling of said packages;

joining means for interconnecting said first and second elongate members at several of said intersections so as to form a rigid unit, said joining means including adhesive placed at a plurality of said intersections and cured to securely bond said elongate members together;

said first and second elongate members being channels made from sheet metal; and said joining means including a first section of material from one of said plurality of first elongate members which is pressed through a second section on one of said plurality of second elongate members, said sections being clinched together to form a secure interconnection therebetween, which clinched sections both temporarily hold said intersections together until said adhesive cures, and also add to the ultimate strength of the intersection.

2. An apparatus as set forth in claim 1 wherein said clinched sections each have a pull strength of about 2000 PSI after said adhesive cures.

3. An apparatus as set forth in claim 1 wherein said adhesive is an epoxy adhesive.

4. An apparatus as set forth in claim 3 wherein said adhesive is a two-part, room temperature curing epoxy.

5. An apparatus as set forth in claim 1 wherein said first and second elongate members are channels made from aluminum alloy to minimize weight.

6. An apparatus as set forth in claim 5 wherein said channels are made from a 3000 series aluminum alloy.

7. A spacer for supporting packages, comprising:

a plurality of first elongate members extending in a first direction;

a plurality of second elongate members extending in a direction substantially normal to said first direction, said first and second elongate members engaging one another at a plurality of intersections, said first and second elongate members defining a pair of spaced parallel support surfaces for supporting packages placed thereagainst and forming multiple interconnected passageways therebetween for communicating conditioned air therethrough, said first and second elongate members having a structural strength permitting layers of said packages to be alternatingly stacked with said spacers to form a multi-layered arrangement to facilitate cooling, stacking, transporting and handling of said packages;

joining means for interconnecting said first and second elongate members at several of said intersections so as to form a rigid unit, said joining means including adhesive placed at a plurality of said intersections and cured to securely bond said elongate members together;

said plurality of first and second elongate members including first and second flanges that engage to form said intersections; and said joining means including sections of material from said flanges interengaged with one another for temporarily holding said flanges together at said intersections until said adhesive cures, said joining means adding to the ultimate strength of the intersections.

8. An apparatus as set forth in claim 7 wherein said adhesive is an epoxy.

9. An apparatus as set forth in claim 7 wherein at least some of said elongate members include locating means for locating said spacer relative to an identical spacer to prevent skewing of the stacked arrangement when the identical spacer is stacked on said spacer.

10. An apparatus as set forth in claim 1 wherein at least some of said elongate members include locating means for locating said spacer relative to an identical spacer to prevent skewing of the stacked arrangement when the identical spacer is stacked on said spacer.

11. A spacer for supporting packages, comprising:

a plurality of first elongate members extending in a first direction;

a plurality of second elongate members extending in a direction substantially normal to said first direction, said first and second elongate members engaging one another at a plurality of intersections, said first and second elongate members defining a pair of spaced parallel support surfaces for supporting packages placed thereagainst and forming multiple interconnected passageways therebetween for communicating conditioned air therethrough, said first and second elongate members having a structural strength permitting layers of said packages to be alternatingly stacked with said spacers to form a multi-layered arrangement to facilitate cooling, stacking, transporting and handling of said packages;

joining means for interconnecting said first and second elongate members at several of said intersections so as to form a rigid unit;

at least some of said elongate members including locating means for locating said spacer relative to an identical spacer when placing one or more of the identical spacers on said spacer, whereby said spacer can be stacked on other identical spacers when not in the use to form a stable, non-skewing stacked arrangement; and said locating means including an aperture located on one of said spaced support surfaces, and further including an embossment located on the other of said spaced support surfaces and extending in a direction away from said one spaced support surface, said embossment on said spacer being positioned and configured to mateably engage said aperture on an identical spacer when stacked thereon.

12. An apparatus as set forth in claim 11 wherein said spacer includes a pair of said apertures and a pair of said embossments.

13. An apparatus as set forth in claim 12 wherein each of said second elongate members includes ends and further includes one of said embossments at each end so that said second elongate members all have an identical shape, and each of said first elongate members includes a plurality of said apertures corresponding to the number of second elongate members so that said first elongate members all have an identical shape, said plurality of apertures being spaced apart so that, when the first and second elongate members are assembled, the outermost pair of said second elongate members include an arrangement of said apertures which can mateably accept the corresponding arrangement of said embossments on said first elongate members on an identical spacer when stacked thereon.

14. A spacer for supporting packages, comprising:

a plurality of first channels;

a plurality of second channels positioned transversely to the first channels;

said first and second channels having a cross-sectional shape so that, when transversely positioned, the channels define a pair of spaced apart planar surfaces supported by load bearing walls extending therebetween, the planar surfaces being adapted to support packages placed thereon or to be supported by packages placed thereunder, the cross-sectional shape of the first and second channels further defining multiple passageways adapted to communicate conditioned air between the packages when the spacer is arranged in a stack with the packages, the first and second channels engaging each other at a plurality of intersections;

adhesive placed on at least some of said intersections to securely bond the channels together at said at least some intersections;

said first and second channels include flanges located between and parallel to the pair of spaced apart planar surfaces, the flanges engaging one another at the plurality of intersections; and mechanical joining means including deformed material on said flanges for interconnecting the flanges at the intersections, the joining means holding the flanges together at the intersections while the adhesive is cured and also adding to the ultimate strength of the intersection.

15. An apparatus as set forth in claim 14 wherein at least some of said channels include locating means for locating said spacer relative to an identical spacer to prevent skewing of a stacked arrangement created by placing one or more of the identical spacers on said spacer.

16. An apparatus as set forth in claim 15 wherein said locating means includes an aperture located in one of the planar surfaces, and further includes an embossment located on the other of the planar surfaces and protruding outwardly therefrom, said embossment on said spacer being positioned and configured to mateably engage said aperture on an identical spacer when stacked thereon.

17. An apparatus as set forth in claim 14 wherein said spacer is rectangular and said channels include flanges forming a rectangular perimeter having four corners, said four corners being radiused to increase safety by eliminating sharp corners at the four corners.

18. An apparatus as set forth in claim 14 wherein said channels include laterally extending flanges with outer edges, and each of said outer edges are folded back on itself to form a hem which eliminates sharp edges, increases the stiffness of the channel, and forms a grip permitting an operator to pull one of said spacers from a multi-layered arrangement of spacers and packages.

19. An apparatus as set forth in claim 14 wherein said channels are made from a sheet of material of about 0.040 inches to minimize weight and maximize thermal conductivity.

20. A spacer for supporting packages of food, comprising:

a plurality of first channels;

a plurality of second channels positioned transversely to the first channels;

said first and second channels having a cross-sectional shape so that, when transversely positioned, the channels define a pair of spaced apart planar surfaces supported by load bearing walls extending therebetween, the spaced planar surfaces being adapted to support packages placed thereon or to be supported by packages placed thereunder, the cross-sectional shape of the first and second channels further defining multiple passageways adapted to communicate conditioned air between the packages when the spacer is arranged in a stack with the packages, the first and second channels engaging and joined to each other at a plurality of intersections; and at least some of said channels include locating means for locating said spacer relative to an identical spacer to prevent skewing of a stacked arrangement created by placing one or more of the identical spacers on said spacer, said locating means including an aperture located in one of the spaced planar surfaces, and further including an embossment located on the other of the spaced planar surfaces and protruding outwardly therefrom, said embossment on said spacer being positioned and configured to mateably engage said aperture on an identical spacer when stacked thereon.

21. An apparatus as set forth in claim 20 wherein said spacer is rectangular and said channels include flanges forming a rectangular perimeter having four corners, said four corners being radiused to increase safety by eliminating sharp corners at the four corners.

22. An apparatus as set forth in claim 20 wherein said channels include laterally extending flanges with outer edges, and each of said outer edges are folded back on itself to form a hem which eliminates sharp edges, increases the stiffness of the channel, and forms a grip permitting an operator to pull one of said spacers from a multi-layered arrangement of spacers and packages.

23. An apparatus as set forth in claim 20 wherein said channels are made from a sheet of material of about 0.040 inches to minimize weight and maximize thermal conductivity.

* * * * *

UNITED STATES PATENT AND TRADEMARK OFFICE

CERTIFICATE OF CORRECTION

PATENT NO. : 5,291,836

DATED : March 8, 1994

INVENTOR(S) : John W. Beamer

It is certified that error appears in the above-indentified patent and that said Letters Patent is hereby corrected as shown below:

Column 3, line 4;
After "alternatingly" insert --placed--.

Column 3, line 8;
"Fig." should be --Fig. 2--.

Column 3, line 12;
After "V-V" insert --of--.

Column 3, line 19;
After "spacer" insert --shown in--.

Column 3, line 21;
After "line" insert --X-X in--.

Signed and Sealed this

Twenty-seventh Day of September, 1994

*Attest:*

Bruce Lehman

BRUCE LEHMAN

*Attesting Officer*

*Commissioner of Patents and Trademarks*